US006094494A

United States Patent [19]

Haroldson

[11] Patent Number: 6,094,494

[45] Date of Patent: Jul. 25, 2000

[54] HEARING AID DEVICE AND METHOD FOR PROVIDING AN IMPROVED FIT AND REDUCED FEEDBACK

[76] Inventor: Olaf Haroldson, 27 Roper Rd., Princeton, N.J. 08540

[21] Appl. No.: 09/133,608

[22] Filed: Aug. 13, 1998

[51] Int. Cl.[7] ..... H04R 25/00

[52] U.S. Cl. ..... 381/328; 381/322

[58] Field of Search ..... 381/380, 322, 381/312, 329, 328, 74, 382; 181/130, 135

[56] References Cited

U.S. PATENT DOCUMENTS

| | | | |
|---|---|---|---|
| 3,602,654 | 8/1971 | Victoreen | 181/135 |
| 4,006,796 | 2/1977 | Coehorst . | |
| 4,834,211 | 5/1989 | Bibby et al. | 381/322 |
| 5,002,151 | 3/1991 | Oliveira et al. . | |
| 5,395,168 | 3/1995 | Leenen . | |
| 5,483,027 | 1/1996 | Krause | 181/135 |
| 5,682,020 | 10/1997 | Oliveira . | |
| 5,742,692 | 4/1998 | Garcia et al. . | |

*Primary Examiner*—Vivian Chang
*Attorney, Agent, or Firm*—Mathews, Collins, Shepherd & Gould, P.A.

[57] ABSTRACT

A device and method for fitting a sound transmission device to provide an easy and effective fit, reduce feedback, and improve user comfort comprises an ear-piece component having a face at one end with operative components and a stem adjacent the other end. The stem houses a speaker tube which protrudes from the component, and it has a retaining means for securing an inflatable, resilient fitting balloon thereon. The balloon has a sound transmission duct within it which can be coupled to the speaker tube so that when the balloon is secured to the stem, a continuous path is provided for the transmission of sound from the component to the user's ear canal external the balloon. This assembly (e.g., the component and attached balloon) is inserted into the ear canal when the balloon is in a deflated configuration. Air is then pumped into the balloon, e.g., through an air channel in the ear-piece component, to inflate the fitting balloon. The inflated fitting balloon engages the ear-piece component against the walls of the user's ear canal and prevents sound from traveling to the external ear and face of the component.

14 Claims, 11 Drawing Sheets

HEARING AID DEVICE AND METHOD FOR PROVIDING AN IMPROVED FIT AND REDUCED FEEDBACK

FIELD OF THE INVENTION

The present invention relates to a device and method for transmitting sound to a user's ear canal with a component that provides an improved fit in the ear canal and reduces feedback. More particularly, the invention relates to an assembly for transmitting sound to a user's ear canal comprising an "out-of-the ear" device with an inflatable fitting balloon that projects into the ear canal and gently engages the device against the canal wall.

BACKGROUND OF THE INVENTION

Hearing aid devices are well known. Generally, they can be described as comprising a housing for containing operative sound transmission components such as a microphone, an amplifier, a control (or trimmer) for adjusting the volume, a transducer, and a battery. Basically, the devices operate by receiving sound via the microphone, amplifying the signals, and transmitting them via the transducer into the ear canal toward the tympanic membrane (i.e., the ear drum). An output or speaker tube may project from the hearing aid for channeling or radiating the sound from the transducer into the ear canal. FIG. 1 shows a schematic of the human ear which is helpful in understanding the use and operation of hearing aid devices generally and the inventive device and method in particular.

Referring to FIG. 1, the regions of the external ear 6 and middle and inner ear 8 are divided by dashed line E—E. Conventional hearing aid devices have been placed in and supported substantially by the concha 12, a depressed region within the external ear 6. Generally, the device itself will cover the external acoustic meatus 24, at the opening of the ear canal 26, and may be at least partially seated within the ear canal 26 itself. The microphone for the hearing aid device may be at the external ear, proximal the concha 12, and the output or speaker tube of the hearing aid may protrude within the ear canal, orientated toward the tympanic membrane 28. This membrane operates in conjunction with various bony structures, canals, nerves and nerve endings, shown generally at region 18, which function to enable one to perceive sound. The ear canal 26 is surrounded by a region of cartilage 14 and a bony region 16.

A difficulty encountered with many conventional hearing aid devices relates to fitting the device in the ear canal and the production of acoustic feedback. When there is a gap between the walls of the device and the ear canal, acoustic feedback may result, e.g., sound waves may travel back to the microphone of the device to be re-broadcast through the speaker tube. A cycle of sound may build up, and the feedback causes a loud ringing or whistling noise in the user's ear which is annoying and interferes with the ability to perceive sound. Thus, for this and other reasons it is important that there be a snug but comfortable fit between the device and the ear canal wall. Molds have been made of users' ear canals to provide devices having exterior surfaces providing custom-made fits. These individually-designed devices naturally require a number of visits to the hearing aid dispenser's office, and also, the process of making the molds may cause discomfort. Also, although such conventional hearing aids may project within, and be custom-made to fit, the ear canal, they are supported primarily if not entirely by regions of cartilage, e.g., region 14, not bone, e.g., region 16. With movements in the jaw or during conversation, the dimensions at the cartilage portion 14 may change, which alters the fitting of the device and makes it difficult to securely fit the device in the ear. Changes in the size of the ear canal also may occur with swelling, inflammation, or the accumulation of cerumen, thereby at least partially dislodging the device.

Many efforts have been made to address these problems relating to the fitting of hearing aids and acoustic feedback. A new generation of hearing aid devices have been developed that sit within, and are supported in large part by, the bony portion 16 of the ear canal. See, e.g., U.S. Pat. No. 5,395,168 issued Mar. 7, 1995 to Leenen, "In the Ear Hearing Aid Having Extraction Tube Which Reduces Acoustic Feedback" (the "Leenen patent"). These hearing aids also have drawbacks, however; for example, extracting the devices from the inner ear may pose difficulties for users, who often are senior citizens with reduced dexterity particularly in handling small objects. The Leenen patent describes a device and method for seeking to make it easier to extract an in-the-ear device from the ear. Another difficulty associated with in-the-ear devices relates to user discomfort associated with the making of molds and use of the devices.

Other approaches for improving the fit of hearing aid devices have included attaching foam pieces to the devices with use of adhesives or elongated jelly or liquid-filled pouches. See, for example, the devices described in the following U.S. patents, all of which are incorporated herein by reference: U.S. Pat. No. 5,682,020 issued Oct. 28, 1997, to Oliveira, "Sealing of Hearing Aid to Ear Canal" (the "Oliveira patent"); U.S. Pat. No. 5,002,151 issued Mar. 26, 1991 to Oliveira et al., "Ear Piece Having Disposable, Compressible Polymeric Foam Sleeve"; and U.S. Pat. No. 4,006,796 issued Feb. 8, 1977 to Coehorst, "Ear Piece Which Substantially Consists of a Thin-Walled Flexible Capsule Filled With a Liquid Medium." A recent approach for improving the fit involves providing a range of differently-sized flexible collars to be attached to the end of the device for protruding into the ear canal, wherein the wearing comfort of the user is sought to be optimized by selection of an appropriately-sized collar, as described in U.S. Pat. No. 5,742,692 issued Apr. 21, 1998 to Garcia et al, "In-the-Ear Hearing Aid With Flexible Seal" (hereinafter the "Garcia patent"), also incorporated herein by reference.

As may be appreciated from the foregoing, those concerned with hearing aids and with the comfort and well-being of individuals using them continually search for new designs and components to better fit the devices in the ear, simplify their use and operation, improve the comfort of users, and reduce feedback. It indeed would be advantageous to have an improved hearing aid device and method for fitting and/or sealing the device within the ear. Such and other advantages of this invention are described more fully with the description given below.

SUMMARY OF THE INVENTION

Summarily described, the invention embraces an ear-piece component for transmitting sound to a user's ear canal that provides an improved fit within the user's ear canal and reduces feedback with use of an inflatable, resilient fitting balloon having a sound transmission duct to be secured to the component. The ear-piece component comprises a housing which has a face at one end, a terminus at the other end, and an air channel traversing the housing. The outer surface of the housing adjacent the terminus forms a stem for projecting into the user's ear canal. Operative sound transmission components are contained within the housing adjacent the face. The operative sound transmission components may comprise a microphone, a volume control mechanism, a battery housing, and an amplifier and a transducer. A speaker tube is coupled to the operative sound transmission components and opens adjacent the terminus for radiating sound from the operative components into the sound transmission duct within the fitting balloon that opens to the user's ear canal. A retaining means is disposed on the outer surface of the housing for securing the resilient fitting balloon to the housing so that when the fitting balloon is stretched over the terminus and secured by the retaining means, it will encase the opening of the speaker tube. When the balloon is attached to the housing, air may be pumped through the air channel to inflate the balloon. When the balloon in inflated, it engages the component against the wall of the user's ear canal and prevents sound from traveling back toward the face of the component, thereby reducing feedback.

An assembly for transmitting sound to a user's ear canal comprises the inventive ear-piece component in combination with at least one of the resilient fitting balloon or an inflator for pumping air through the air channel into the balloon. The inventive method comprises providing a sound transmission assembly comprising the inventive ear-piece component and the resilient fitting balloon; securing the balloon on the component so that the speaker tube is coupled to the sound duct and the balloon encases the speaker tube (e.g., by stretching the mouth of the balloon over the retaining means and then releasing the balloon so it retracts toward its original size to press over the retaining means); inserting the component with the attached fitting balloon into the ear canal of the user; and pumping air through the air channel to inflate the fitting balloon so that it engages against the walls of the user's ear canal. An inflator device may be provided for inflating the balloon and to assist in inserting the component and attached balloon into the ear canal of the user.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention, are not to scale, and are not limiting in nature.

DETAILED DESCRIPTION OF THE INVENTION

With this invention, a device and method is provided for fitting a hearing aid which provides an easy and effective fit, prevents or reduces feedback, and improves user comfort. The invention provides the advantage of essentially a "one-size-fits-all" hearing aid device that does not require a custom mold of a user's ear canal. It accommodates for changes in the size of a user's ear canal which may arise from conversation, chewing, swelling, inflammation, accumulation of cerumen, or other factors. The fitting balloon will conform to the unusual shape of various ear canals including variations caused by mastoid surgery, trauma, or congenital influences. The invention also is advantageous in that it does not require use of adhesives or oil, water, or jelly-like pastes.

Figure 2A:
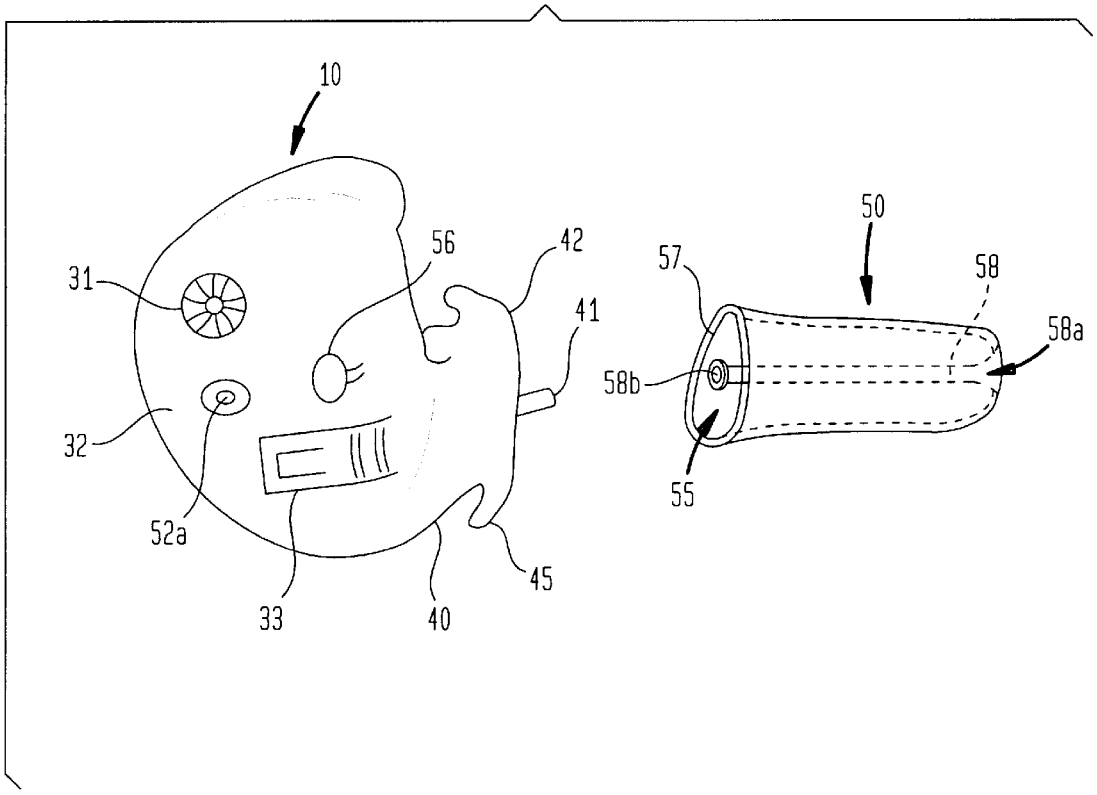
FIGS. 2A–2H illustrate steps for performing the inventive method and using the inventive ear-piece component and assembly.

The basic concepts of the inventive device and method are illustrated in FIGS. 2A–2H. In FIG. 2A, there is shown a schematic perspective view of the inventive assembly for transmitting sound to the ear canal of a user, comprising an ear-piece component 10 and a fitting balloon 50, with certain hidden features shown by dashed lines. Optionally, the device may be provided to the user with an inflator 60 (shown in FIGS. 2G and 8A). The ear-piece component 10 comprises a housing which has a face 32, with certain features accessible to the user (e.g., external the ear canal), when the device is placed in the ear, such as a volume control 31, a battery housing 33, an inlet port for air inflation 52*a*, and an air release valve 56.

The housing also has a stem portion 40 which is configured to project into the user's ear canal and ends in a terminus 42 opposite the face 32. On the outer surface of the housing adjacent the terminus 42 there is disposed a retaining means 45, such as a flange or sulcus; the retaining means preferably is disposed at or adjacent the terminus 42, as shown, but need not be. The retaining means is shown as a sulcus 45 and will be referred to as such in describing FIGS. 2A–2H. A speaker tube 41 advantageously projects from the stem for radiating sound into the ear canal. The fitting balloon 50 essentially comprises an elastic or resilient bag having a mouth 55 bordered by a rim 57 which can be stretched over the terminus 42 of the stem so that the balloon is held thereon by the retaining means 45. In FIGS. 2A–2I, the ear-piece component is shown with hatching to show how it works in conjunction with the balloon In FIGS. 2B, 2D and 2H, an air channel 52 is shown traversing the component which is used to inflate the balloon.

Figure 2B:
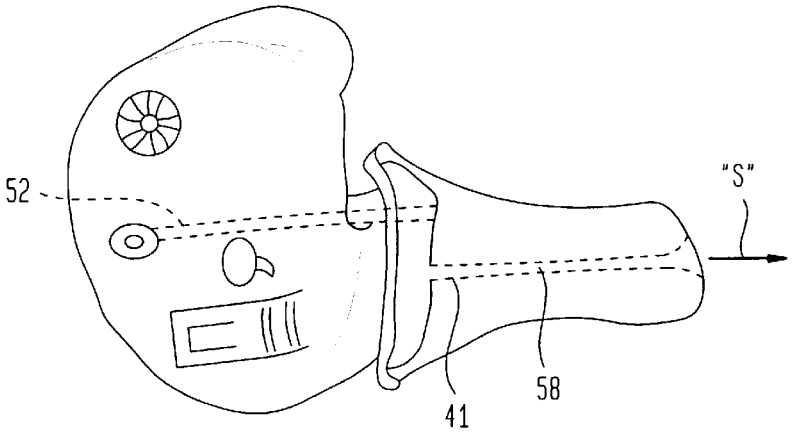

In one embodiment, the ear-piece component 10 may be provided to the user with the balloon secured thereon. However, advantageously the balloon is replaceable, and the user may install new fitting balloons 50 on the ear-piece component 10. In such a case, FIG. 2B shows a first step of using the device and performing the inventive method. The fitting balloon is stretched over the retaining sulcus 45, providing a sealed-fit over the speaker tube 41. The speaker tube 41 is coupled to the sound transmission duct 58, so that there is a continuous path for the transmission of sound from the component to the exterior of the balloon at region "s" of FIG. 2B. Couplers that may be used for this purpose are known and available in the medical field. For example, a coupler referred to as TUBE LOCK™ is available from Precision Ear Mold Lab of Altamonte Springs, Fla.

Figure 2C:
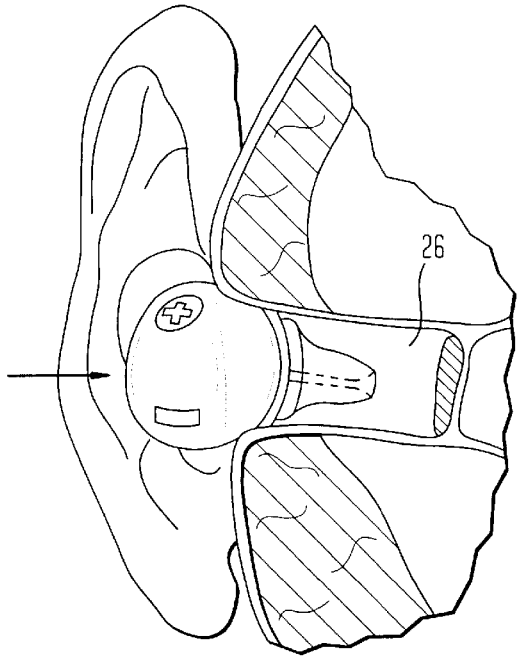

Since the balloon is resilient, once it is stretched over the sulcus and released, it springs back toward its original size and compresses against the sulcus and stem, so that the pressure of the balloon against the sulcus secures the balloon thereon. Referring to FIG. 2C, the ear-piece component 10 with the balloon 50 secured thereon is then inserted into the ear canal 26. This insertion step is according to the invention preferably performed with the help of the inflator 60, as described below. However, other means may also be used to insert the component into the ear which are within the scope of the invention.

Figure 2D:
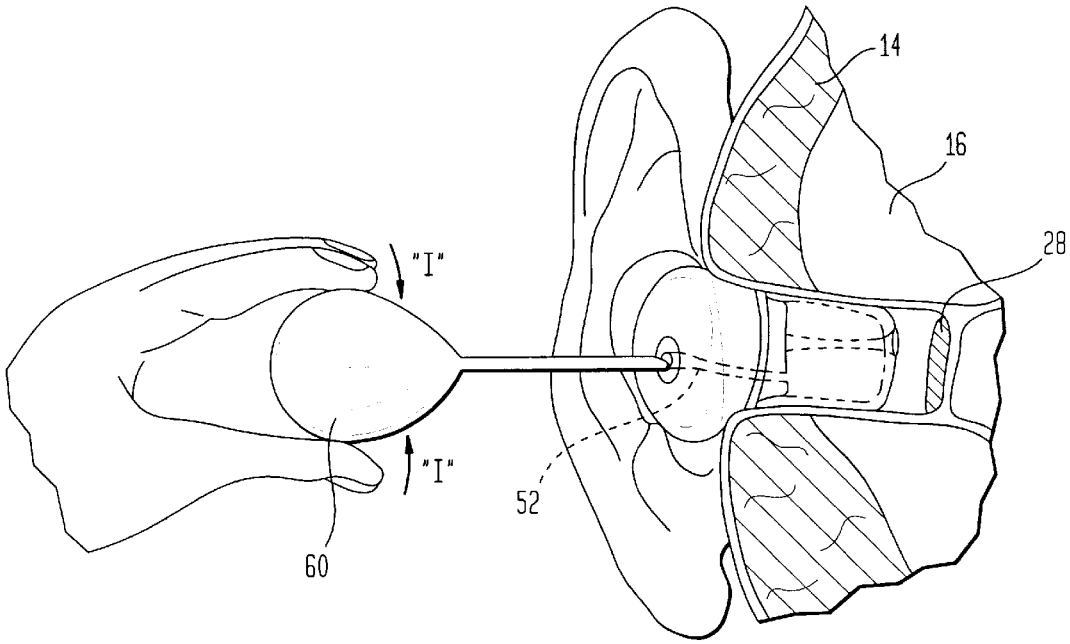
Figure 2E:
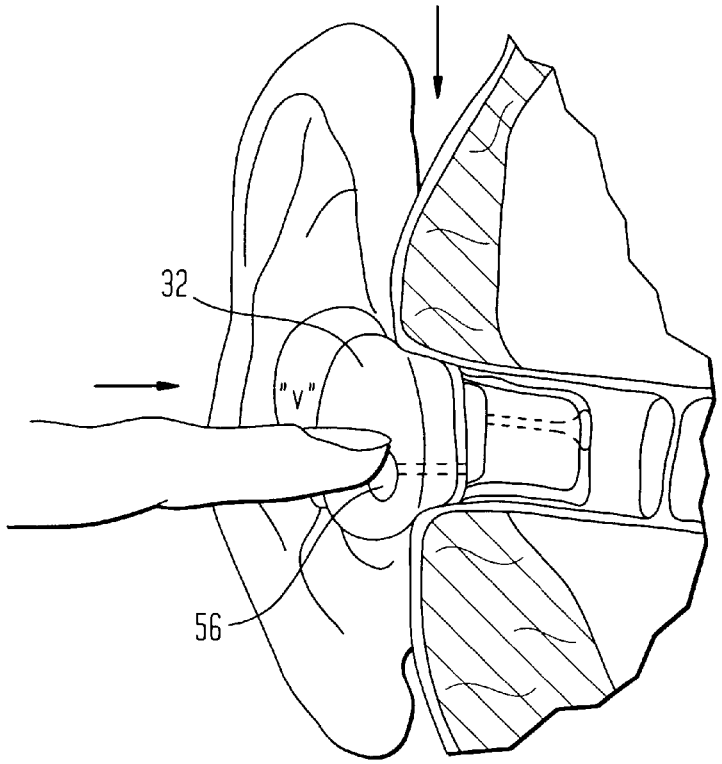

Once in the ear canal (whether inserted manually, with use of the inflator, or by other means), the balloon is inflated so that it engages against the wall of the ear canal preferably with minimal pressure being exerted against it. As shown in FIG. 2D, the inflator 60 may be used to inflate the balloon. At least part of the balloon may engage against the portion of the ear canal adjacent the tympanic membrane and surrounded by bone 16 so that changes in the ear canal caused by variations in the cartilage do not affect the fitting. When the user desires to remove the device, the air release valve 56 on the face 32 of the component may be pressed to release air from the fitting balloon and deflate it, as shown in FIG. 2E, which shows the balloon beginning to deflate. The device with the attached, deflated balloon may then be readily removed from the ear (e.g., FIG. 2F).

Figure 2F:
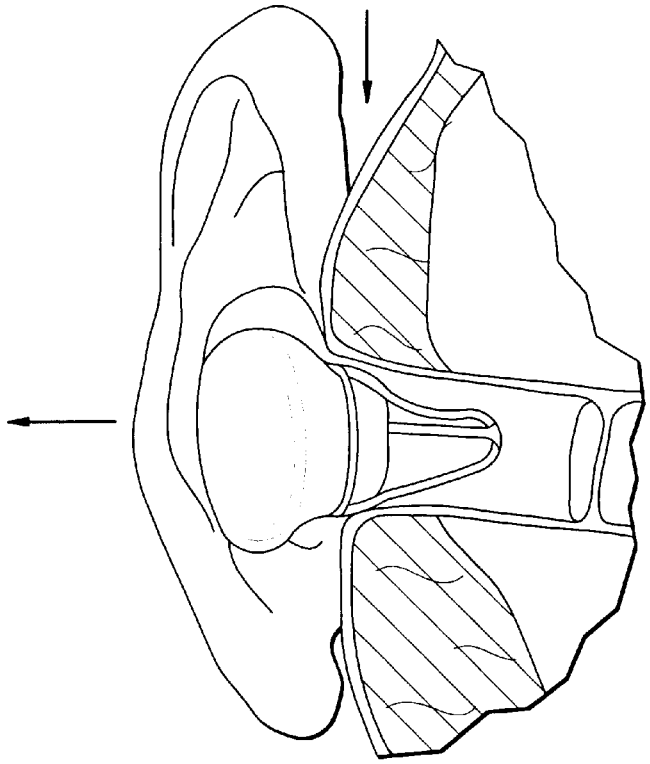
Figure 2G:
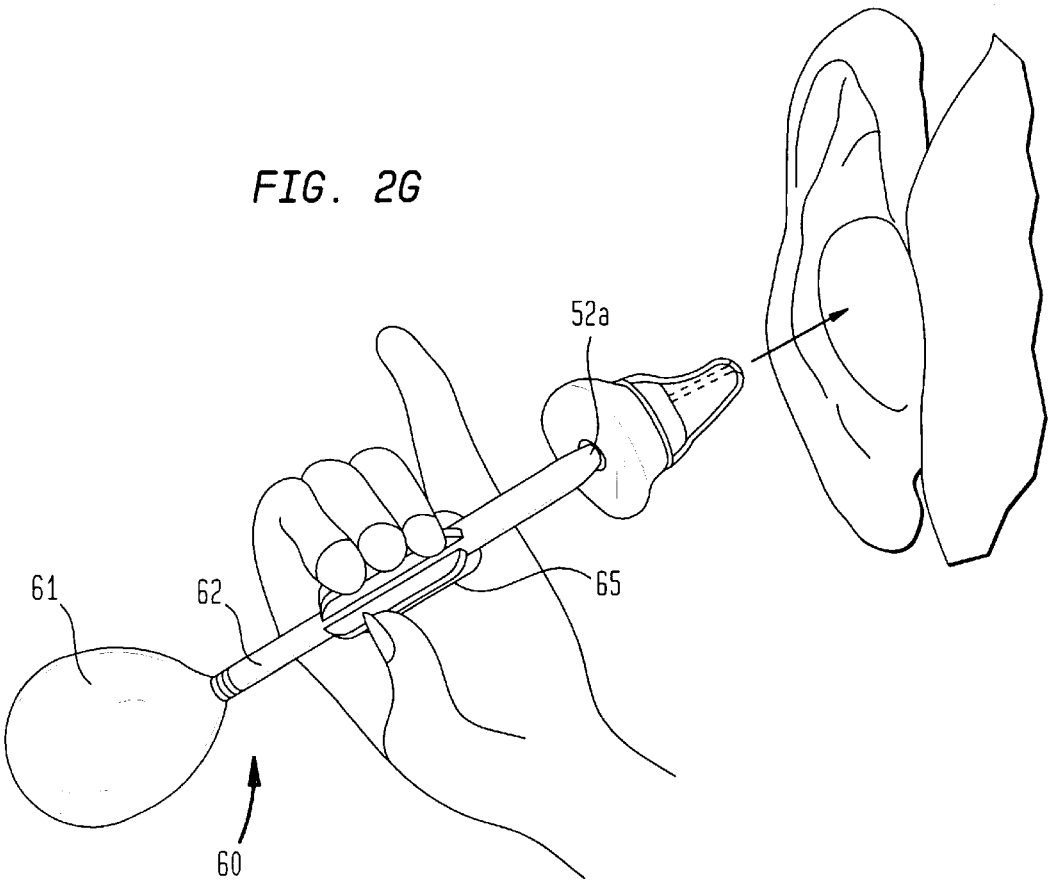
Figure 2H:
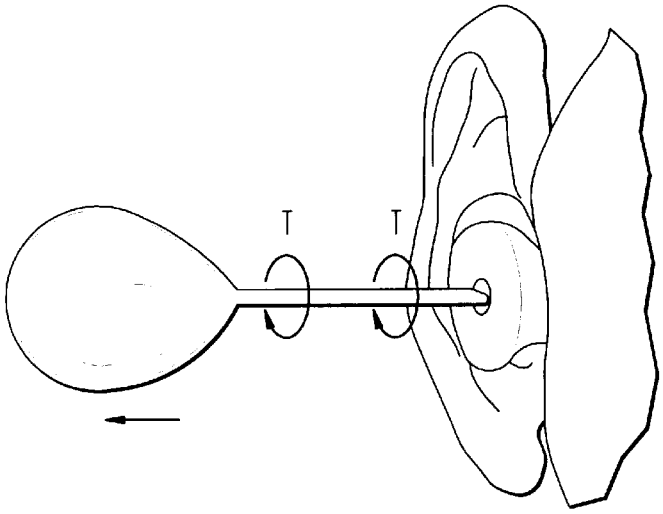

To assist the user in performing this method and using the device, an inflator 60 may be provided, shown in FIGS. 2D, 2G, 2H, and 8A. The inflator 60 may help the user to perform the inflation step of FIG. 2D, and it also may be of assistance in performing the insertion step of FIG. 2C. To illustrate, referring to FIGS. 2G and 8A, the inflator may comprise an inflation bulb 61 attached to a cylindrical hollow rod 62, the rod ending in a tip having an orifice 63 for the passing of air out of the rod. A locking means (64, FIGS. 5A–5B, 7B, and 8A), may be disposed on the exterior of the rod, which is designed to guide or lock the inflator into the inlet port 52*a* on the face 32 of the housing. The exterior of the rod 62 may have ridges 65 thereon to facilitate handling and turning of the inflator. As shown in FIG. 2G, the tip of the inflator may be inserted into the inlet port 52*a* and then the rod locked into the component, before the device is inserted into the ear. The user may grasp the rod of the inflator and while holding the rod insert the component into the ear. Next, gently depressing the bulb of the inflator, the user may inflate the fitting balloon while it is seated in the ear canal (e.g., following arrows "I" of FIG. 2D). The inflator may then be unlocked from the component with use of the locking means, e.g., by twisting it following the arrows "T" of FIG. 2H, and removed from the component, the latter remaining in the ear.

Figure 1:
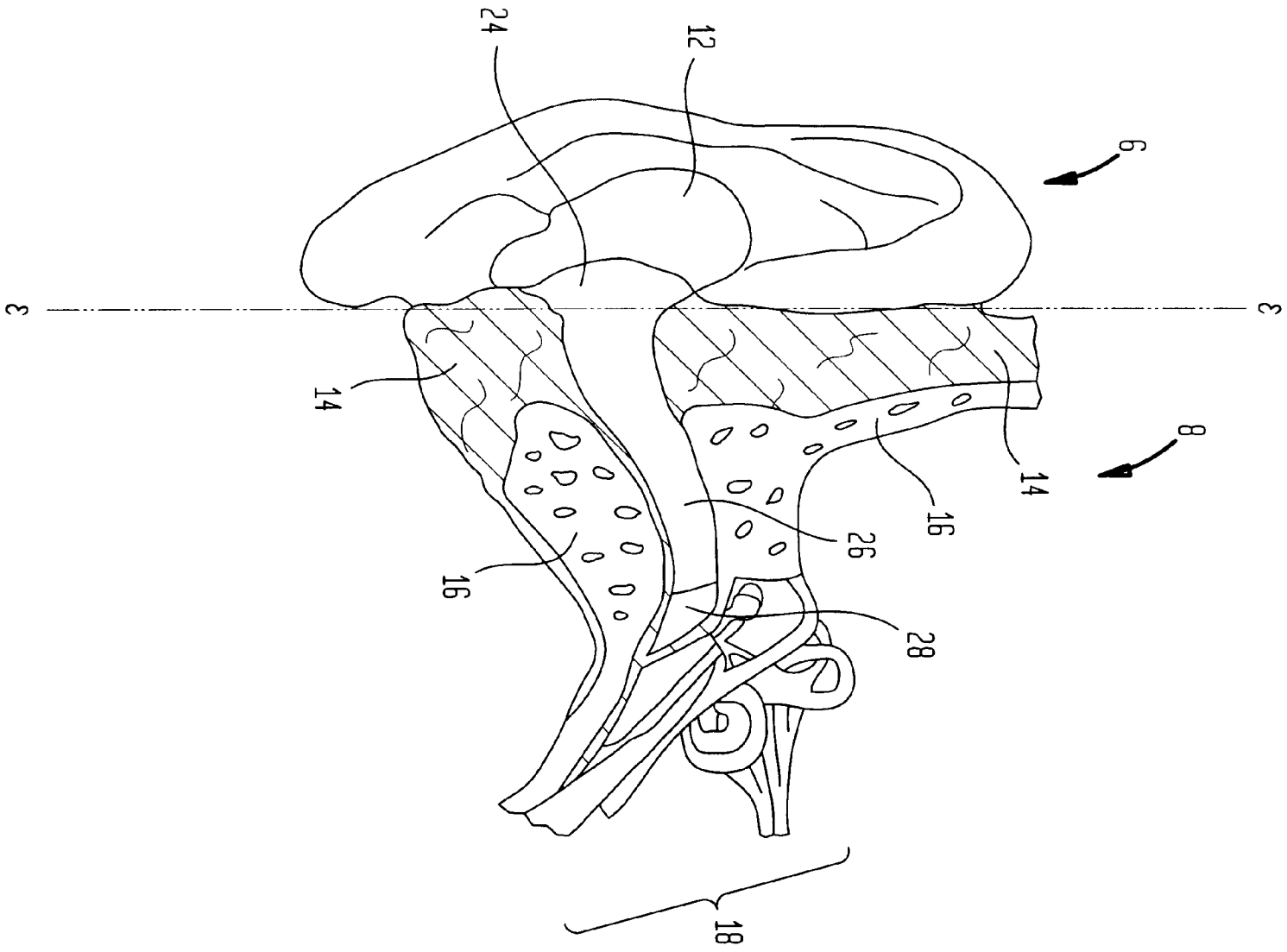
FIG. 1 is an illustration of the human ear.
Figure 3:
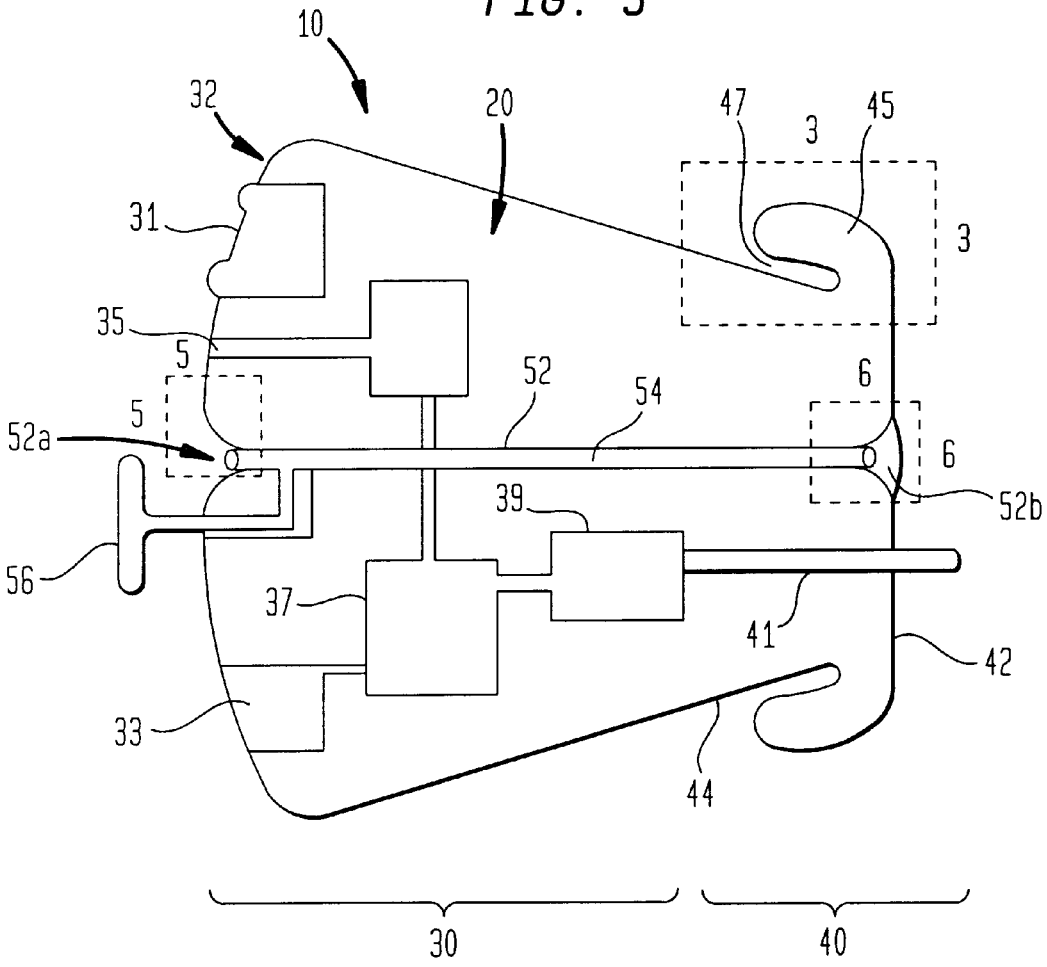
FIG. 3 shows a cross-sectional view of one embodiment of the inventive ear-piece component.

FIGS. 3 through 10 show in greater detail various embodiments of the inventive assembly for transmitting sound to a user's ear canal. Referring to FIG. 3, there is shown a schematic, cross-sectional view of one embodiment of the inventive hearing aid device or ear-piece component 10. The component comprises a housing 20 having a "hearing aid proper" portion 30 for containing operative components and the stem 40 for projecting into the ear canal and containing the speaker tube 41. The hearing aid proper 30 abuts the face 32 which is designed to rest at the user's concha (12, FIG. 1), external the ear canal, so that the user may access features at the face when the device is placed in the ear. The hearing aid proper contains components such as the control 31, e.g., for adjusting the volume, and the battery housing 33. A microphone 35 also may be in communication with the housing face 32. An amplifier 37 and an electroacoustic transducer 39 for converting an electric signal into sound generally will be disposed within the hearing aid proper. Other additional or alternative operative components may be used, however, as are known or developed. As may be apparent, the use and advantages of this invention are not dependent upon the particular type of operative components used.

Figure 3A:
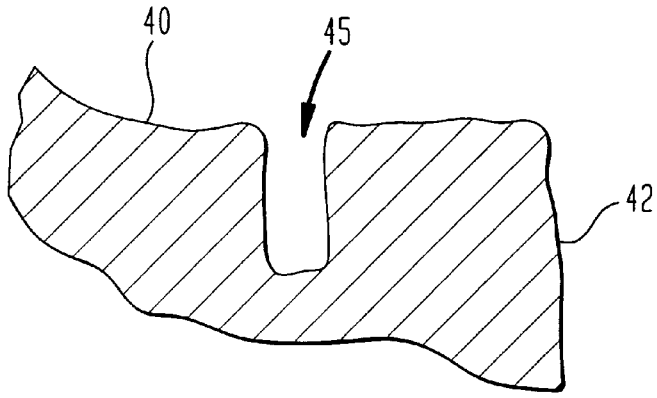
FIG. 3A shows a cut-away alternative view of the retaining means at boxed region 3—3 of FIG. 3.

As discussed above with reference to FIG. 2A, the stem 40 has a terminus 42 that extends into the ear canal, with a speaker tube 41 extending from the transducer that advantageously projects beyond the terminus for coupling to the sound transmission duct 58 of the balloon (FIG. 4B), and for radiating sound. The stem 40 preferably has an outer surface 44 which is substantially smooth or rounded, and a retaining means 45, such as a flange or sulcus, is disposed thereon. The retaining means 45 is shown in FIG. 3 in the form of a sulcus, i.e., as a projection encircling the circumference of the stem at the terminus, with a narrow grooved portion 47 oriented in the direction of the face 32. However, the retaining means may take many alternative forms; for example, it may comprise one or more protruding ribs, ridges, rims, collars, or edges disposed on the external surface of the housing at or inward of the terminus, or it may comprise a deep narrow groove, as illustrated in FIG. 3A, which is a cut-away view of an alternative retaining means at boxed region 3—3 of FIG. 3. Preferably, the retaining means comprises a sulcus as in FIG. 3.

In accordance with the invention, extending from the face 32 of the hearing aid proper 30 to the terminus 42 there is disposed an air channel 52 for inflating the fitting balloon 50 with air, with an inlet port 52*a* at the face and an outlet port 52*b* at the terminus. Although the air channel 52 is shown disposed basically along the central axis of the housing, it may be placed at different regions (e.g., adjacent an exterior surface of the housing), with important considerations being that the inlet port 52*a* be accessible to the user when the device is placed in the ear and the outlet port 52*b* opening to the mouth of the fitting balloon when it is stretched over the stem (see, e.g., FIG. 2B). An inner sleeve 54 may be placed within the air channel, for providing a means to inflate or deflate the balloon 50, when the device is placed in the ear. The face 32 of the housing advantageously also carries the raised air release valve 56 for opening the air channel from inlet port 52*a* to outlet port 52*b*, thereby allowing the balloon to deflate while the device is in the ear (FIGS. 2E–2F). Advantageously, the release valve 56 is placed as far away as possible from the volume control mechanism 31, so that the user in adjusting the volume will not accidentally depress the air release valve 56 and deflate the balloon.

Figure 4A:
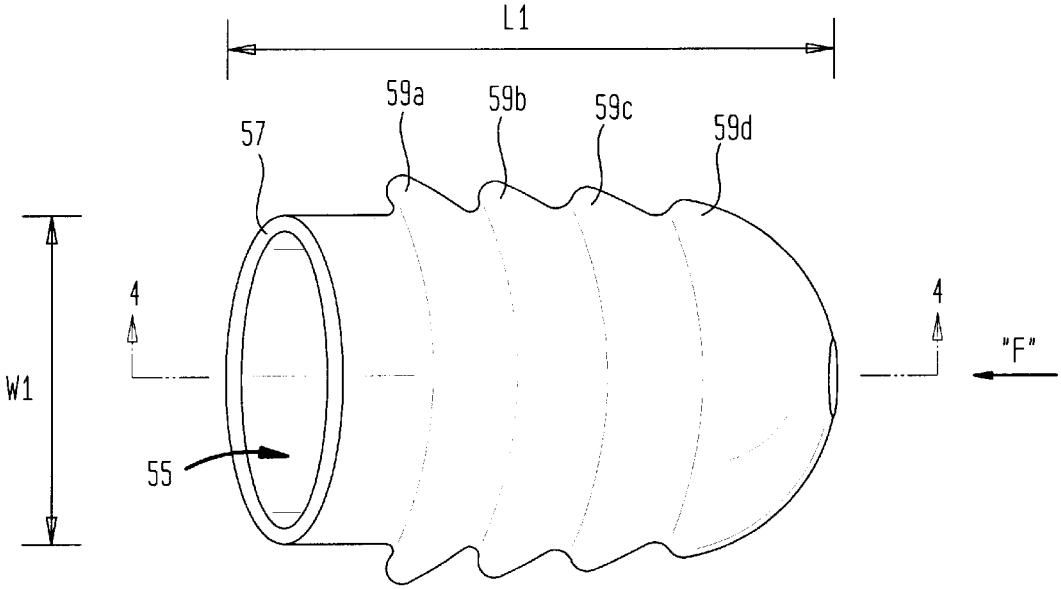
FIG. 4A shows one embodiment of the fitting balloon to be used in conjunction with the inventive ear-piece component.
Figure 4B:
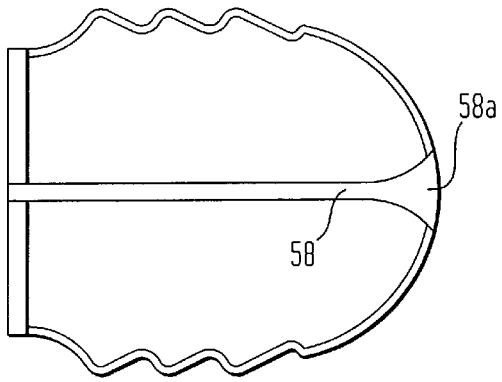
FIG. 4B shows a cross-sectional side view of the fitting balloon of FIG. 4A taken along the line 4—4 of FIG. 4A.
Figure 4C:
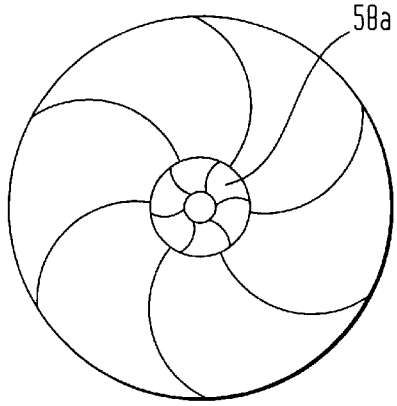
FIG. 4C shows a perspective view of the face end of the fitting balloon looking in the direction of arrow "F" of FIG. 4A.

Referring to FIG. 4, there is shown a perspective view of an embodiment of the resilient fitting balloon 50 which is designed to be placed over the stem and secured thereon by the retaining means 45. The fitting balloon has a mouth 55, encircled by an essentially tubular elastic rim 57, the circumference of which is sized smaller than the outer circumference of the stem. Being resilient by definition, the balloon can be expanded to stretch over the retaining means 45, and then when released, it will retract toward its original size to press over or into the retaining means so that the fitting balloon is secured on the stem. The balloon, by definition, is comprised of a material that is at least substantially impervious to air. Also, it should be sufficiently elastic or resilient so that it is inflatable from a deflated configuration to an inflated configuration with gentle pumping of air within the mouth 55. The balloon is flexible and can engage against the wall of the ear canal with minimal pressure being exerted against it. Although latex has these properties, it probably should be avoided as many people exhibit allergic reactions to it. An inflatable plastic material is preferred.

Within the balloon and traversing its length there is disposed the sound transmission duct 58, to allow for the passing of sound from the speaker tube 41 of the component to the inner ear canal adjacent the tympanic membrane when the device is engaged in the ear. The end of the duct 58*b* adjacent the mouth 55 may be coupled to the speaker tube to provide a continuous passage. The end of the duct 58*a* at the closed end of the balloon may end in a spout 58*a*, which is advantageous not only for the fanning out of the sound, but also as an anchor for retaining the duct on the balloon. The outer surface of the balloon may have one or more ridges 59*a*, 59*b*, 59*c*, 59*d*, to help seat the balloon in the ear canal and prevent slippage. Preferably, the ridges have a gentler angle adjacent the tympanic membrane (59*a*, 59*b*), and a sharper angle adjacent the external ear (59*c*, 59*d*). The balloon may be provided in a variety of sizes, with differing lengths "L1" and widths "W1," which may be selected as appropriate depending on the particular user. Advantageously, the length of the deflated balloon L1 ranges from about one centimeter to about 1.5 centimeters and the width W1 from about 0.5 centimeters to 1.0 centimeters. The length and width may be expandable to upwards of about 2.5 and 3.5 cm, respectively. Naturally, for individuals having larger than average ear canal sizes, differently-sized balloons may be provided. For example, patients having had certain mastoid operations such as fenestration or modified radial mastoidectomy will have relatively large-sized ear canals and will require balloons expandable to larger dimensions. The resilience of the material used to make the balloon in conjunction with the retaining means on the stem of the ear piece are sufficient to hold the balloon securely on the hearing aid, and no additional adhesives are required. Additionally, no oil, water, or jelly-like pastes, are required to use this device.

Figure 5A:
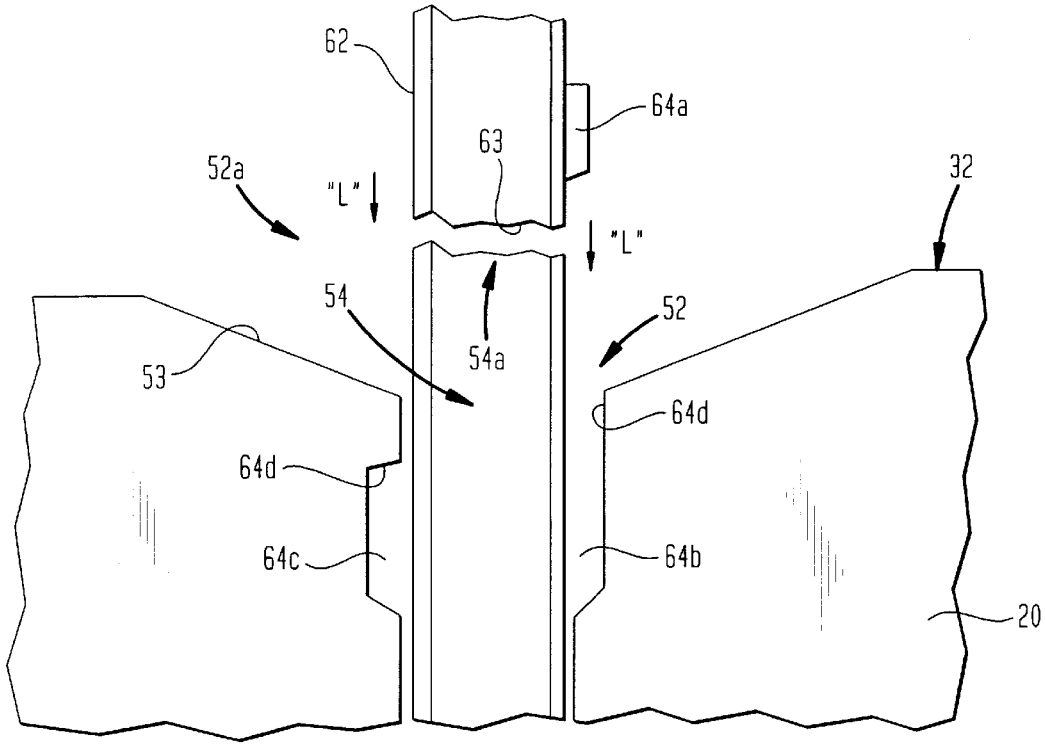
FIG. 5A shows an exploded view of one embodiment of the inlet port at boxed region 5—5 of FIG. 3 with the inner sleeve of the air channel in the raised position.
Figure 5B:
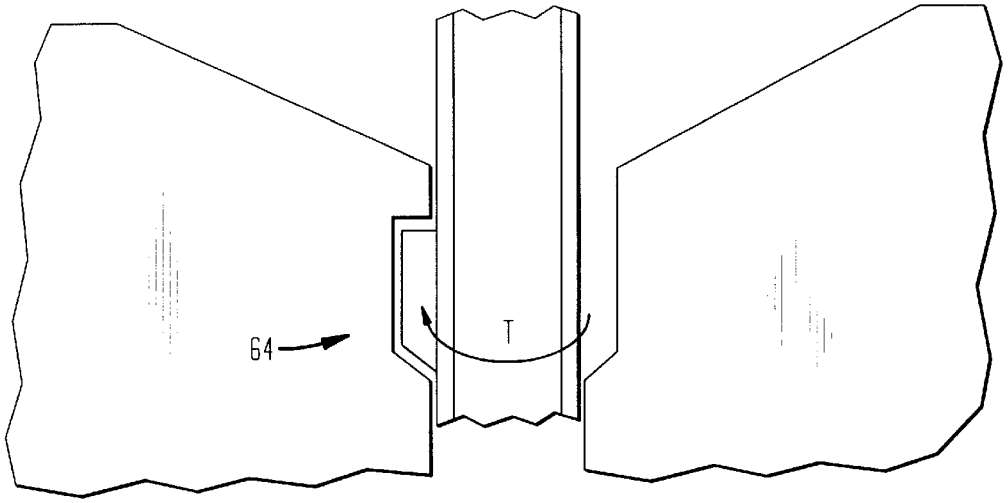
FIG. 5B shows an exploded view of one embodiment of the inlet port at boxed region 5—5 of FIG. 3 with the inner sleeve of the air channel in the depressed, locked position.
Figure 6A:
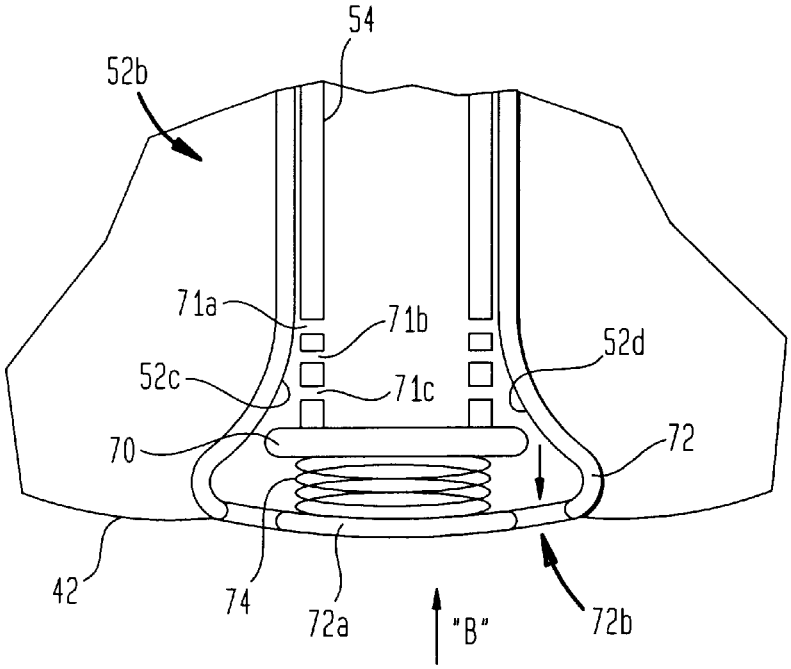
FIG. 6A shows an exploded cross-sectional view of the outlet port at boxed region 6—6 of FIG. 3.
Figure 6B:
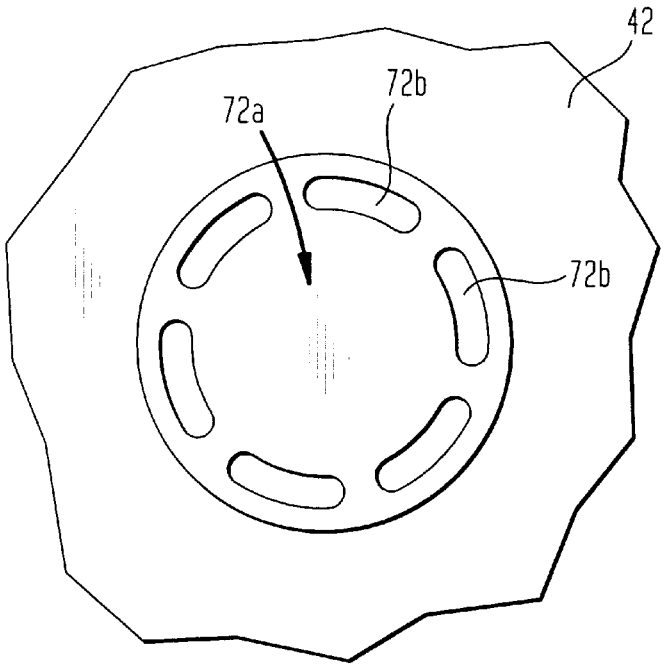
FIG. 6B shows a perspective bottom view of the outlet port of FIG. 6A looking in the direction of arrow "B" of FIG. 6B.

FIGS. 5A, 5B, 6A and 6B show in greater detail exemplary features for the inlet and outlet ports of the air channel 52. FIGS. 5A and 5B show an exploded view of one embodiment of the inlet port at boxed region 5—5 of FIG. 3 with the inner sleeve 54 in the raised and depressed positions, respectively, together with the tip of the inflator rod 62. FIG. 6A shows an exploded view of the outlet port at boxed region 6—6 of FIG. 3, and FIG. 6B shows a perspective bottom view of the outlet port of FIG. 6A looking in the direction of arrow "B" of FIG. 6B. Looking at FIG. 5A, the inner sleeve 54 consists of a cylindrical tube that can slide back and forth within the air channel.

As shown in FIGS. 5A–5B, the surface of the face 32 at the inlet port 53 may slope downwardly to form a funnel. The upper edge of the sleeve 54*a* may be notched or scalloped as shown to correspond to notches or scallops at the tip 63 of the rod 62 of the inflator 60. In this way, the user can readily ensure that the tip 63 is engaged to the sleeve 54 in the proper position for locking of the inflator. A locking means 64 in this embodiment comprises a tab 64*a*, extending outwardly from the outer surface of the inflator rod 62, together with a slot 64*b* and cavity 64*c* in the air channel wall adjacent the inlet port that correspond generally in size to the tab 64*a*. Although not shown in FIGS. 5A–5B, the upper rim of the slot 64*d* may curve gradually downward away from the face in either a clockwise or counterclockwise direction so that the rim will define the cavity 64*c* having exterior dimensions sized slightly greater than the size of the locking tab 64*a*. In operation, the tip 63 of the inflator is lined up with and engaged to the upper edge 54*a* of the sleeve. The rod 62 is then depressed, following arrows "L," thereby depressing the sleeve and sliding the locking tab 64*a* into the slot 64*b*. The rod 62 is then twisted, e.g., following arrow "T" of FIG. 5B, so that the locking tab is secured within the cavity 64*c*, and the sleeve is prevented from returning to its raised position (FIG. 5A), by the rim 64*d*. The inflator 60 is then locked into the component, so that it may be used to hold the component in the air against the force of gravity and may aid the user in inserting the component into the ear canal (FIG. 2G). Also, as can be seen in FIG. 5A, in this embodiment the sleeve 54 in its "at rest" position protrudes above the surface of the face 32 of the hearing aid device. Finger pressure against the tip of the sleeve 54 can release air from and deflate the balloon, thereby obviating the need for a separate air release valve 56.

Referring to FIG. 6A, at the outlet port 52*b*, the air channel 52 terminates in a bell-like extension 72 which will be oriented toward the tympanic membrane. A gasket 70 covers the end of the inner sleeve 54 adjacent the outlet port. Proximal the gasket 70 the sleeve 54 has a ring of perforations 71*a*, 71*b*, 71*c*, which allow air to be discharged from within the sleeve to the bell 72 of the outlet port and out of the housing. (Since FIG. 6A provides a cross-sectional view, the perforations 71*a*, 71*b*, 71*c*, appear to provide open spaces in the sleeve but the sleeve is a continuous member with the perforations simply comprising holes for the passage of air from within the sleeve to within the bell-like extension 72.) A spring 74 is secured between the central bottom of the bell 72*a* and the gasket 70. Looking at FIGS. 6A and 6B, the bottom of the bell comprises a solid central portion 72*a* and openings or slots 72*b*, to allow for the passage of air out of the housing. When the sleeve is closed or in the at rest position, the spring 74 is expanded and biases the sleeve within the air channel, so that the gasket 70 seals against the walls 52*c*, 52*d*, of the air channel, and air cannot pass out of the sleeve through perforations 71*a*, 71*b*, 71*c*, etc. However, when the sleeve is depressed into the open position (FIG. 5B), the spring is compressed so that gasket 70 moves toward the bottom 72*a* of the bell, and the perforations 71*a*, 71*b*, 71*c*, are in open communication with the slots 72*b*, so that air may travel out of the housing. Alternative to the embodiment shown in FIG. 6B, the slots may comprise openings in a radial grill-like or spoke-like structure encircling the central portion at the bottom of the bell 72*a*.

Figure 7A:
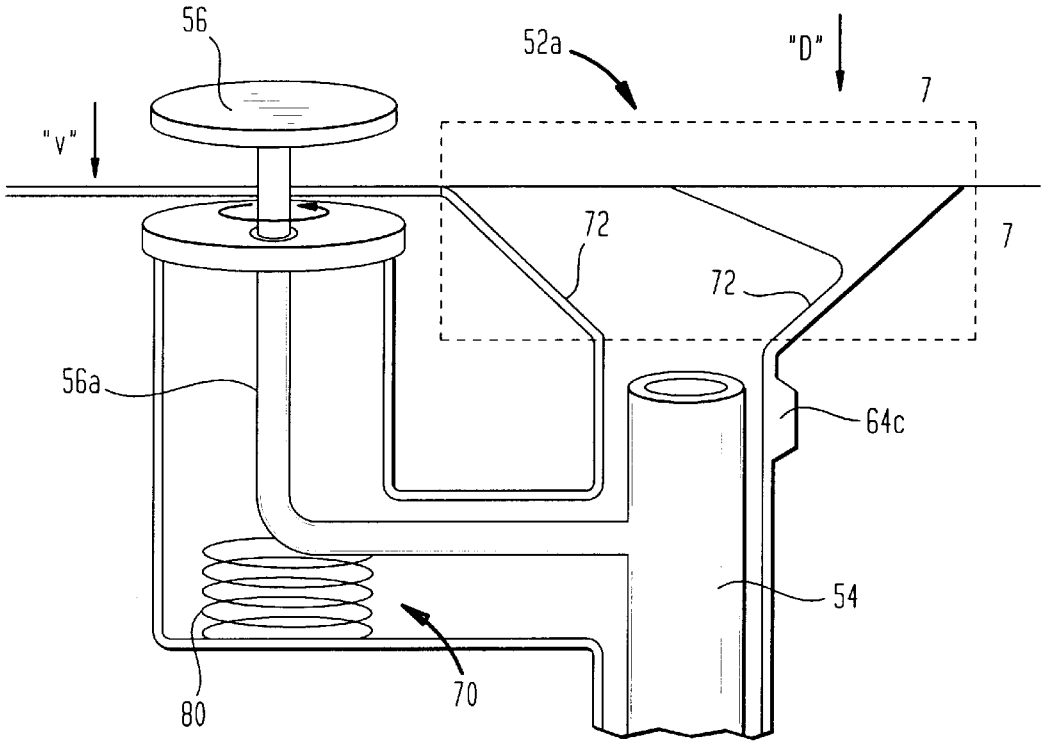
FIG. 7A shows an exemplary embodiment of a raised air release valve.
Figure 7B:
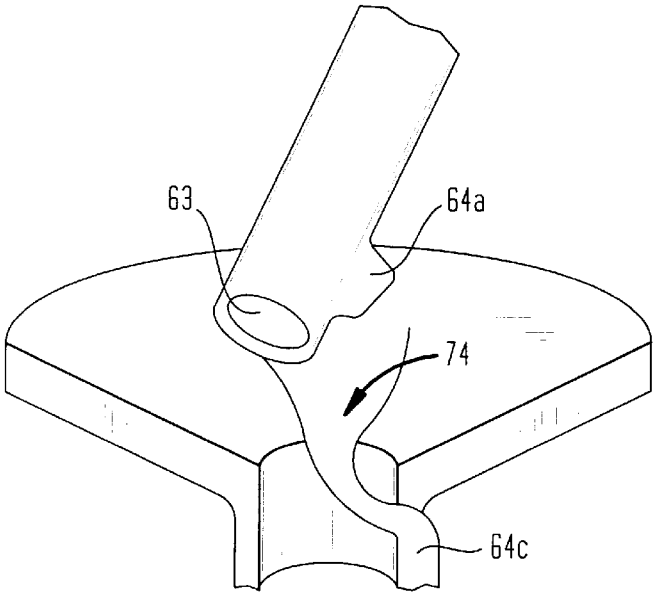
FIG. 7B shows an exploded view of the funnel port at boxed region 7—7 of FIG. 7A along with the tip of an inflator being inserted therein.
Figure 7C:
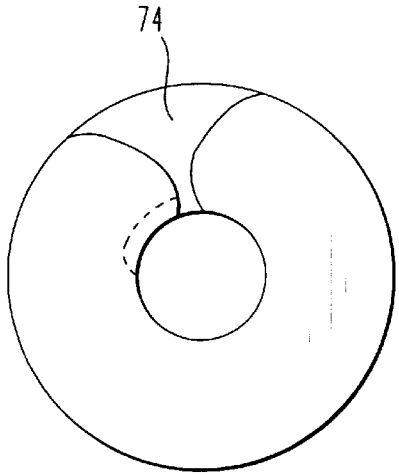
FIG. 7C shows a top view of the funnel port of FIG. 7B looking in the downward direction following arrow "D" of FIG. 7A.

FIGS. 7A–7C show an exemplary embodiment of a raised air release valve 56, and an alternative embodiment of the inlet port 52*a* at boxed region 5—5 of FIG. 3. The valve may be connected to the inner sleeve by a connection arm 56*a*, disposed within an air valve chamber 70, for holding the arm 56*a* and providing a space in which the arm may move. The valve 56 and arm 56*a* are biased by a spring 80 or by the spring 74 at the bottom of the outlet port 52*b* (FIG. 6A). As should be apparent, either one of the springs 74 or 80 may be used alone, or the two springs may be used together for additional biasing power. When the valve 56 is depressed following arrow "v" of FIG. 7A, the inner sleeve is caused to move to the open, depressed position (FIG. 6A), so that the perforations 71*a*, 71*b*, 71*c*, are in open communication with the slots 72*b*, as described above in FIG. 6, and air may travel out of the housing.

In this embodiment (FIGS. 7A–7C), the inner sleeve 54 is shown recessed in the air channel 52. The surface of the face 32 slopes downward toward the channel with a sloping sidewall 72 to define a funnel-shaped opening (FIGS. 7A and 7B), to allow for easier engagement of the inflator 60 to the ear piece component 10. As shown in FIGS. 7B and 7C, a groove 74 may be defined within the funnel surface from the face 32, along the sidewall 72 toward the channel 52. Preferably, the groove 74 is also somewhat funnel-shaped as shown in FIGS. 7A–7B, being wider at its upper opening adjacent the face and becoming gradually narrower to guide the locking tab 64*a* of the inflator rod into cavity 64*c*. The groove 74 would open into cavity 64*c* to facilitate the locking of the inflator to the component and the insertion of the component into the ear canal (FIG. 2G).

Figure 8A:
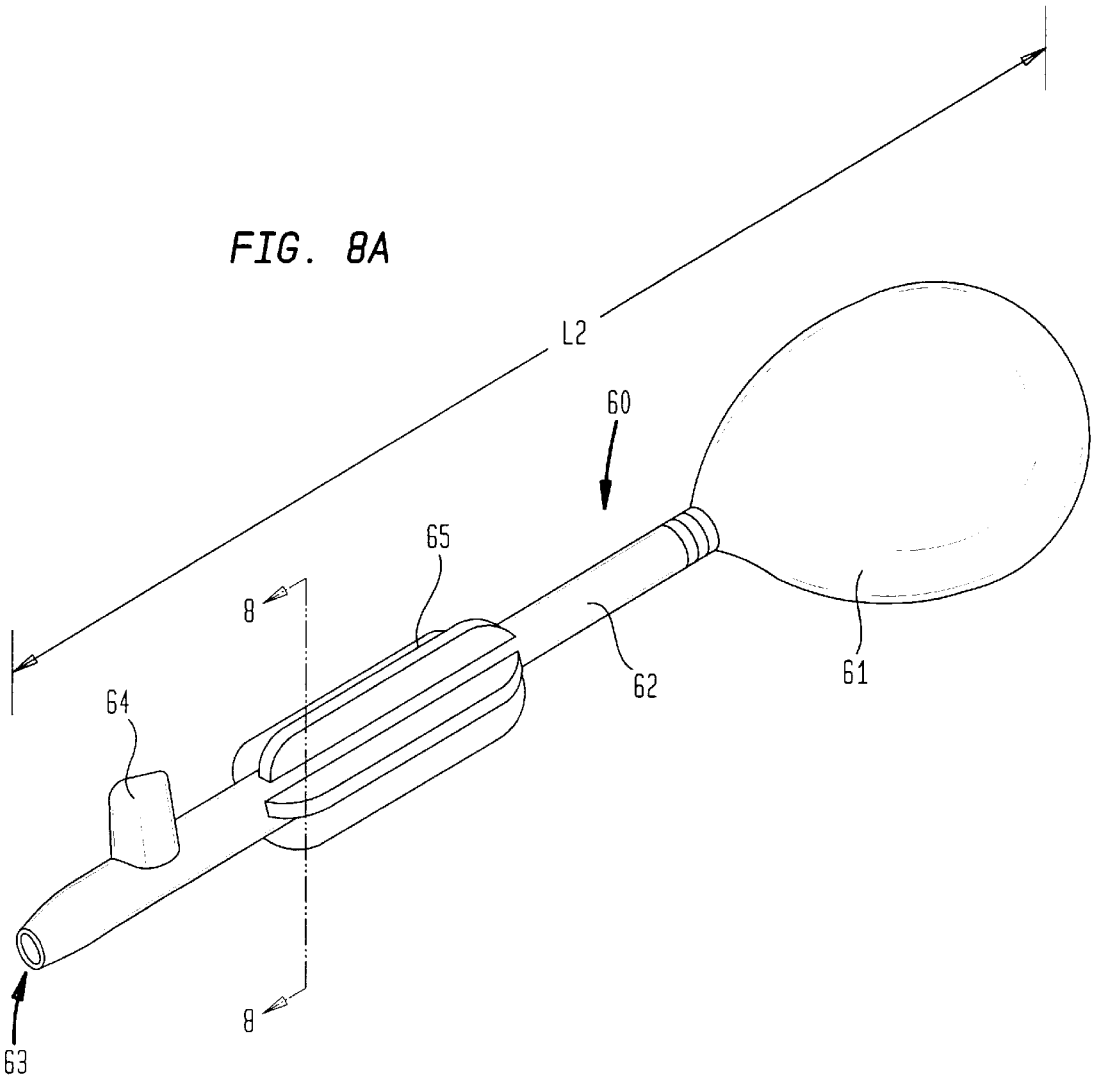
FIG. 8A shows a perspective view of an exemplary embodiment of the inflator including the locking means.
Figure 8B:
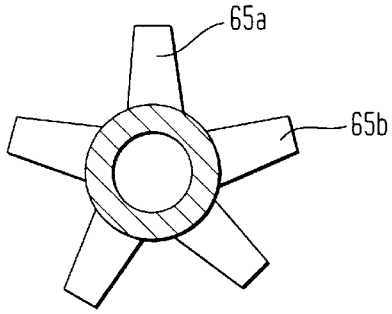
FIG. 8B shows a cross-sectional view of the inflator taken along the line 8—8 of FIG. 8A.

FIG. 8A shows a perspective view of an exemplary embodiment of the inflator including an alternative embodiment of the locking means 64, and FIG. 8B shows a cross-sectional view of the inflator taken along the line 8—8 of FIG. 8A, to show the ridges in more detail. The ridges 65*a*, 65*b*, etc., are advantageous to facilitate the gripping and handling of the inflator. The total length of the inflator L2 should be relatively short to allow for easy handling in one hand, namely, about 11 to 12 cm. In this embodiment, the locking means comprises a cylindrical tab protruding upward from the rod 62 which will become lodged within the cavity 64*c*.

It is understood that the embodiments described herein are merely exemplary and that a person skilled in the art may make variations and modifications without departing from the spirit and scope of the invention. For example, other locking means may be used to secure the inflator to the ear piece component, with the locking means shown herein as being exemplary. Also, it is known that there are a variety of hearing aid devices which rest behind the user's external ear, with a speaker tube that projects into the ear canal. In that case, the resilient balloon may be directly secured to the piece or tube that projects into the ear canal, and the retaining means for securing the balloon would be disposed on the piece projecting into the ear canal. All such variations and modifications are intended to be included within the scope of the appended claims.

I claim:

1. An ear-piece assembly for transmitting sound to a user's ear canal that provides an improved fit within the walls of the user's ear canal and reduces feedback, the assembly comprising:

an ear-piece component comprising a housing for containing sound transmission components, having a face surface and an oppositely-disposed stem portion for projecting into the user's ear canal, a speaker tube connected to the sound transmission components and extending to the exterior of the housing at the stem portion for radiating sound into the user's ear canal, an air channel extending through the component from the face surface to the stem portion, and a ridge disposed on the exterior of the housing at the stem portion; and an inflatable, resilient fitting balloon having a mouth, a closed end, and a sound transmission duct therein extending from the mouth to the closed end, wherein the sound transmission duct couples to the speaker tube adjacent the mouth and opens at the closed end, so that the fitting balloon may be removably fitted over the speaker tube at the stem portion of the housing and extend into the ear canal and inflated with air passed through the air channel such that the balloon will engage against the walls of the user's ear canal with the duct providing a continuous path for the passage of sound from the sound transmission components, through the speaker tube, through the duct, and into the user's ear canal.

2. The assembly of claim 1, in which the fitting balloon has ridges on its exterior surface for engaging against the walls of the user's ear canal.

3. The assembly of claim 1, further comprising an inflator for use in pumping air through the air channel to inflate the fitting balloon, the inflator comprising an inflator bulb coupled to a hollow rod ending in a tip, the tip having an orifice for the passing of air out of the rod.

4. The assembly of claim 3, in which the air channel has an inlet port at the face and an outlet port at the stem portion, and the inlet port is funnel-shape to facilitate the insertion of the tip of the inflator into the air channel.

5. The assembly of claim 4, further comprising an inner sleeve disposed within the air channel for use in opening and closing the air channel to the pumping of air therethrough.

6. The assembly of claim 5, in which the inner sleeve is spring-biased into a closed position, so that when the sleeve is depressed in the direction opposite the face, the spring is compressed and the air channel opens to allow for the passing of air therethrough.

7. The assembly of claim 6, in which the sleeve has an upper end opening to the inlet port, and both the tip of the inflator and the upper end of the sleeve have corresponding notches or scallops thereon to facilitate the engagement of the tip to the upper end of the sleeve.

8. The assembly of claim 5, in which the sleeve has an upper end opening adjacent the inlet port; and further comprising a cavity within the inlet port and a locking tab disposed on the exterior surface of the rod of the inflator, wherein the cavity is sized larger than the locking tab so that the locking tab may be held within the cavity with the tip of the inflator pressed against the upper end of the sleeve and the inflator thereby secured to the component.

9. The assembly of claim 8, in which a groove or channel is disposed within the funnel-shaped inlet port for the guiding of the locking tab into the cavity.

10. The assembly of claim 4, further comprising an air-release valve on the face of the component for releasing air from the balloon and thereby deflating the balloon when the balloon is engaged within the user's ear canal.

11. The assembly of claim 4, in which the outlet port comprises a bell-shaped chamber with openings to allow for the passing of air from the chamber to the exterior of the component.

12. A method for providing an improved fit between a sound transmission device and the walls of a user's ear canal, the method comprising:

providing a sound transmission assembly according to claim 1;

coupling the speaker tube to the sound transmission duct adjacent the mouth of the balloon;

stretching the mouth of the balloon over the retaining means so that the fitting balloon is secured on the housing of the component and encases the speaker tube and the sound transmission duct;

inserting the component with attached fitting balloon into the ear canal of the user; and pumping air into the fitting balloon so that it engages the ear-piece component against the walls of the user's ear canal.

13. The method of claim 12, further comprising the steps of pressing an air release valve on the face of the housing to release air from the balloon and thereby deflate the fitting balloon and thereafter removing the balloon from the user's ear canal.

14. The method of claim 13, further comprising the steps of providing the assembly of claim 4, inserting the tip of the inflator into the inlet port of the air channel, and depressing the inflator bulb to pump air from through the air channel to the balloon, thereby inflating the balloon.

* * * * *